US010235957B2

(12) United States Patent
Gong et al.

(10) Patent No.: US 10,235,957 B2
(45) Date of Patent: Mar. 19, 2019

(54) GATE DRIVER ON ARRAY CIRCUIT AND LIQUID CRYSTAL DISPLAY PANEL

(71) Applicant: Wuhan China Star Optoelectronics Technology Co., Ltd., Wuhan, Hubei (CN)

(72) Inventors: Qiang Gong, Hubei (CN); Gui Chen, Hubei (CN); Guanghui Hong, Hubei (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 267 days.

(21) Appl. No.: 15/321,389

(22) PCT Filed: Oct. 12, 2016

(86) PCT No.: PCT/CN2016/101913

§ 371 (c)(1),
(2) Date: Dec. 22, 2016

(87) PCT Pub. No.: WO2018/032594

PCT Pub. Date: Feb. 22, 2018

(65) Prior Publication Data

US 2018/0211621 A1 Jul. 26, 2018

(30) Foreign Application Priority Data

Aug. 17, 2016 (CN) ..... 2016 1 0679337

(51) Int. Cl.
*G09G 3/36* (2006.01)

(52) U.S. Cl.
CPC ..... *G09G 3/3677* (2013.01); *G09G 3/36* (2013.01); *G09G 3/3696* (2013.01); *G09G 2310/0291* (2013.01); *G09G 2310/061* (2013.01)

(58) Field of Classification Search
CPC ..... G09G 3/3677; G09G 3/36; G09G 3/3696; G09G 2310/0291; G09G 2310/061
See application file for complete search history.

(56) References Cited

U.S. PATENT DOCUMENTS

2017/0032757 A1* 2/2017 Itoigawa ..... H03L 7/00

* cited by examiner

*Primary Examiner* — Sejoon Ahn
(74) *Attorney, Agent, or Firm* — Muncy, Geissler, Olds & Lowe, P.C.

(57) ABSTRACT

A gate driver on array circuit includes a first driver module and a second driver module. The first driver module includes a first driver unit, a first output unit, and a first reset unit. The second driver module includes a second driver unit, a second output unit, and a second reset unit. The first output unit is used for generating a present stage scan drive signal and a present stage cascade signal. The second output unit is used for generating the present stage scan drive signal and the present stage cascade signal.

10 Claims, 4 Drawing Sheets

GATE DRIVER ON ARRAY CIRCUIT AND LIQUID CRYSTAL DISPLAY PANEL

FIELD OF THE DISCLOSURE

The present invention relates to the field of driving display panels, and more particularly to a gate driver on array (GOA) circuit and a liquid crystal display panel.

BACKGROUND

A gate driver on array (GOA) circuit is manufactured using an array process of an existing thin-film transistor display device, to fabricate a scan line drive signal circuit on an array substrate, so as to achieve a driving method where scan lines are scanned line by line.

An existing GOA circuit comprises a cascade signal latch module, a gate drive signal generation module, and a gate drive signal output module. The above mentioned modules have a plurality of thin film transistors. However, because the modules of the existing GOA circuit have the plurality of thin film transistors, the GOA circuit occupies a large space. Thus, it is disadvantageous to design a corresponding liquid crystal display panel with a narrow frame.

Accordingly, it is necessary to provide a GOA circuit and a liquid crystal display panel to solve the technical problem in the prior art.

SUMMARY OF THE INVENTION

An object of the present invention is to provides a gate driver on array (GOA) circuit and a liquid crystal display panel for preferably achieving that a liquid crystal display panel is designed with a narrow frame, so as to solve the technical problem caused from the GOA circuit occupies a large space, so it is disadvantageous to design the liquid crystal display pane with a narrow frame.

An embodiment of the present invention provides a gate driver on array (GOA) circuit, comprising: a first driver module for driving an odd-numbered row of pixel units and a second driver module for driving an even-numbered row of pixel units;

where the first driver module comprises:

a first driver unit receiving a previous stage cascade signal and generating a cascade drive signal and a reset signal according to the cascade signal;

a first output unit transmitting the cascade drive signal and a clock signal in a first state passing through a clock inverter, and generating a present stage scan drive signal and a present stage cascade signal; and a first reset unit cancelling the present stage scan drive signal according to the reset signal;

the second driver module comprises:

a second driver unit receiving the previous stage cascade signal, and generating the cascade drive signal and the reset signal according to the cascade signal;

a second output unit transmitting the cascade drive signal and a clock signal in a second state passing through a transmission gate, and generating the present stage scan drive signal and the present stage cascade signal; and a second reset unit cancelling the present stage scan drive signal according to the reset signal;

where an electric potential of the clock signal in the first state is opposite to an electric potential of the clock signal in the second state; and where a state of the clock signal is changed according to a transmission cycle of the cascade signal; if the reset signal is at a low voltage, the corresponding first driver module or the corresponding second driver module is reset.

Another embodiment of the present invention provides a gate driver on array (GOA) circuit, comprising: a first driver module for driving an odd-numbered row of pixel units and a second driver module for driving an even-numbered row of pixel units;

where the first driver module comprises:

a first driver unit receiving a previous stage cascade signal and generating a cascade drive signal and a reset signal according to the cascade signal;

a first output unit transmitting the cascade drive signal and a clock signal in a first state passing through a clock inverter, and generating a present stage scan drive signal and a present stage cascade signal; and a first reset unit cancelling the present stage scan drive signal according to the reset signal;

the second driver module comprises:

a second driver unit receiving the previous stage cascade signal, and generating the cascade drive signal and the reset signal according to the cascade signal;

a second output unit transmitting the cascade drive signal and a clock signal in a second state passing through a transmission gate, and generating the present stage scan drive signal and the present stage cascade signal; and a second reset unit cancelling the present stage scan drive signal according to the reset signal;

where an electric potential of the clock signal in the first state is opposite to an electric potential of the clock signal in the second state.

In the GOA circuit of the present invention, the first driver unit comprises a first PMOS transistor, a first NMOS transistor, and a first inverting amplifier;

a control terminal of the first PMOS transistor is connected with a reset signal source, an input terminal of the first PMOS transistor is connected with a high voltage signal source, an output terminal of the first PMOS transistor is connected with an input terminal of the first inverting amplifier and an output terminal of the first NMOS transistor, respectively;

the previous stage cascade signal is inputted into a control terminal of the first NMOS transistor, and an input terminal of the first NMOS transistor is connected with a low voltage signal source.

In the GOA circuit of the present invention, the first output unit comprises the clock inverter, a second inverting amplifier, a third inverting amplifier, and a fourth inverting amplifier;

a control terminal of the clock inverter is connected with an output terminal of the first driver unit, the clock signal in the first state is inputted into an input terminal of the clock inverter, an output terminal of the clock inverter is connected with an input terminal of the second inverting amplifier;

an output terminal of the second inverting amplifier is connected with an input terminal of the third inverting amplifier, an output terminal of the third inverting amplifier is connected with an input terminal of the fourth inverting amplifier, the present stage scan drive signal is outputted by an output terminal of the fourth inverting amplifier, and the present stage cascade signal is outputted by the output terminal of the second inverting amplifier.

In the GOA circuit of the present invention, the first reset unit comprises a second PMOS transistor, a third PMOS transistor, and a fourth PMOS transistor;

an output terminal of the second PMOS transistor is connected with the output terminal of the first PMOS transistor, the previous stage cascade signal is inputted into a control terminal of the second PMOS transistor, an input terminal of the second PMOS transistor is connected with an output terminal of the third PMOS transistor;

the present stage cascade signal is inputted into a control terminal of the third PMOS transistor, and an input terminal of the third PMOS transistor is connected with the high voltage signal source;

an input terminal of the fourth PMOS transistor is connected with the high voltage signal source, an output terminal of the fourth PMOS transistor is connected with the output terminal of the clock inverter, and a control terminal of the fourth PMOS transistor is connected with an output terminal of the first inverting amplifier.

In the GOA circuit of the present invention, the second driver unit comprises a fifth PMOS transistor, a second NMOS transistor, and a fifth inverting amplifier;

a control terminal of the fifth PMOS transistor is connected with a reset signal source, an input terminal of the fifth PMOS transistor is connected with a high voltage signal source, an output terminal of the fifth PMOS transistor is connected with an input terminal of the fifth inverting amplifier and an output terminal of the second NMOS transistor, respectively;

the previous stage cascade signal is inputted into a control terminal of the second NMOS transistor, and an input terminal of the second NMOS transistor is connected with the low voltage signal source.

In the GOA circuit of the present invention, the second output unit comprises the transmission gate, a sixth inverting amplifier, a seventh inverting amplifier, and an eighth inverting amplifier;

a control terminal of the transmission gate is connected with an output terminal of the second driver unit, the clock signal in the first state is inputted into an input terminal of the transmission gate, an output terminal of the transmission gate is connected with an input terminal of the sixth inverting amplifier;

an output terminal of the sixth inverting amplifier is connected with an input terminal of the seventh inverting amplifier, an output terminal of the seventh inverting amplifier is connected with an input terminal of the eighth inverting amplifier, the present stage scan drive signal is outputted by an output terminal of the eighth inverting amplifier, and the present stage cascade signal is outputted by the output terminal of the sixth inverting amplifier.

In the GOA circuit of the present invention, the second reset unit comprises a sixth PMOS transistor, a seventh PMOS transistor, and an eighth PMOS transistor;

an output terminal of the sixth PMOS transistor is connected with the output terminal of the fifth PMOS transistor, the previous stage cascade signal is inputted into a control terminal of the sixth PMOS transistor, an input terminal of the sixth PMOS transistor is connected with an output terminal of the seventh PMOS transistor;

the present stage cascade signal is inputted into a control terminal of the seventh PMOS transistor, an input terminal of the seventh PMOS transistor is connected with the high voltage signal source;

an input terminal of the eighth PMOS transistor is connected with the high voltage signal source, an output terminal of the eighth PMOS transistor is connected with the output terminal of the transmission gate, and a control terminal of the eighth PMOS transistor is connected with an output terminal of the fifth inverting amplifier.

In the GOA circuit of the present invention, a state of the clock signal is changed according to a transmission cycle of the cascade signal.

In the GOA circuit of the present invention, if the reset signal is at a low voltage, the corresponding first driver module or the corresponding second driver module is reset.

The present invention also provides a liquid crystal display panel, comprising a gate driver on array (GOA) circuit, where the GOA circuit comprises a first driver module for driving an odd-numbered row of pixel units and a second driver module for driving an even-numbered row of pixel units;

where the first driver module comprises:

a first driver unit receiving a previous stage cascade signal and generating a cascade drive signal and a reset signal according to the cascade signal;

a first output unit transmitting the cascade drive signal and a clock signal in a first state passing through a clock inverter, and generating a present stage scan drive signal and a present stage cascade signal; and a first reset unit cancelling the present stage scan drive signal according to the reset signal;

the second driver module comprises:

a second driver unit receiving the previous stage cascade signal, and generating the cascade drive signal and the reset signal according to the cascade signal;

a second output unit transmitting the cascade drive signal and a clock signal in a second state passing through a transmission gate, and generating the present stage scan drive signal and the present stage cascade signal; and a second reset unit cancelling the present stage scan drive signal according to the reset signal;

where an electric potential of the clock signal in the first state is opposite to an electric potential of the clock signal in the second state.

In the liquid crystal display panel of the present invention, the first driver unit comprises a first PMOS transistor, a first NMOS transistor, and a first inverting amplifier;

a control terminal of the first PMOS transistor is connected with a reset signal source; an input terminal of the first PMOS transistor is connected with a high voltage signal source, an output terminal of the first PMOS transistor is connected with an input terminal of the first inverting amplifier and an output terminal of the first NMOS transistor, respectively;

the previous stage cascade signal is inputted into a control terminal of the first NMOS transistor, and an input terminal of the first NMOS transistor is connected with a low voltage signal source.

In the liquid crystal display panel of the present invention, the first output unit comprises the clock inverter, a second inverting amplifier, a third inverting amplifier, and a fourth inverting amplifier;

a control terminal of the clock inverter is connected with an output terminal of the first driver unit, the clock signal in the first state is inputted into an input terminal of the clock inverter, an output terminal of the clock inverter is connected with an input terminal of the second inverting amplifier;

an output terminal of the second inverting amplifier is connected with an input terminal of the third inverting amplifier, an output terminal of the third inverting amplifier is connected with an input terminal of the fourth inverting amplifier, the present stage scan drive signal is outputted by an output terminal of the fourth inverting amplifier, and the present stage cascade signal is outputted by the output terminal of the second inverting amplifier.

In the liquid crystal display panel of the present invention, the first reset unit comprises a second PMOS transistor, a third PMOS transistor, and a fourth PMOS transistor;

an output terminal of the second PMOS transistor is connected with the output terminal of the first PMOS transistor, the previous stage cascade signal is inputted into a control terminal of the second PMOS transistor, an input terminal of the second PMOS transistor is connected with an output terminal of the third PMOS transistor;

the present stage cascade signal is inputted into a control terminal of the third PMOS transistor, and an input terminal of the third PMOS transistor is connected with the high voltage signal source;

an input terminal of the fourth PMOS transistor is connected with the high voltage signal source, an output terminal of the fourth PMOS transistor is connected with the output terminal of the clock inverter, and a control terminal of the fourth PMOS transistor is connected with an output terminal of the first inverting amplifier.

In the liquid crystal display panel of the present invention, the second driver unit comprises a fifth PMOS transistor, a second NMOS transistor, and a fifth inverting amplifier;

a control terminal of the fifth PMOS transistor is connected with a reset signal source, an input terminal of the fifth PMOS transistor is connected with a high voltage signal source, an output terminal of the fifth PMOS transistor is connected with an input terminal of the fifth inverting amplifier and an output terminal of the second NMOS transistor, respectively;

the previous stage cascade signal is inputted into a control terminal of the second NMOS transistor, and an input terminal of the second NMOS transistor is connected with the low voltage signal source.

In the liquid crystal display panel of the present invention, the second output unit comprises the transmission gate, a sixth inverting amplifier, a seventh inverting amplifier, and an eighth inverting amplifier;

a control terminal of the transmission gate is connected with an output terminal of the second driver unit, the clock signal in the first state is inputted into an input terminal of the transmission gate, an output terminal of the transmission gate is connected with an input terminal of the sixth inverting amplifier;

an output terminal of the sixth inverting amplifier is connected with an input terminal of the seventh inverting amplifier, an output terminal of the seventh inverting amplifier is connected with an input terminal of the eighth inverting amplifier, the present stage scan drive signal is outputted by an output terminal of the eighth inverting amplifier, and the present stage cascade signal is outputted by the output terminal of the sixth inverting amplifier.

In the liquid crystal display panel of the present invention, the second reset unit comprises a sixth PMOS transistor, a seventh PMOS transistor, and an eighth PMOS transistor;

an output terminal of the sixth PMOS transistor is connected with the output terminal of the fifth PMOS transistor, the previous stage cascade signal is inputted into a control terminal of the sixth PMOS transistor, an input terminal of the sixth PMOS transistor is connected with an output terminal of the seventh PMOS transistor;

the present stage cascade signal is inputted into a control terminal of the seventh PMOS transistor, an input terminal of the seventh PMOS transistor is connected with the high voltage signal source;

an input terminal of the eighth PMOS transistor is connected with the high voltage signal source, an output terminal of the eighth PMOS transistor is connected with the output terminal of the transmission gate, and a control terminal of the eighth PMOS transistor is connected with an output terminal of the fifth inverting amplifier.

In the liquid crystal display panel of the present invention, a state of the clock signal is changed according to a transmission cycle of the cascade signal.

In the liquid crystal display panel of the present invention, if the reset signal is at a low voltage, the corresponding first driver module or the corresponding second driver module is reset.

In comparing of the existing GOA circuit and liquid crystal display panel, in the GOA circuit and the liquid crystal display panel of the present invention, by applying a common clock signal to the first driver module and the second driver module, an occupancy space of the GOA circuit is thus decreased, and it is easy to design the liquid crystal display panel with a narrow frame. The technical problem caused by the existing GOA circuit in the liquid crystal display panel occupies a large space, so it is disadvantageous to design the liquid crystal display panel with a narrow frame is solved.

In order to make the present invention more clear, preferred embodiments and the drawings thereof are described in detail below.

DETAILED DESCRIPTION

Figure 1:
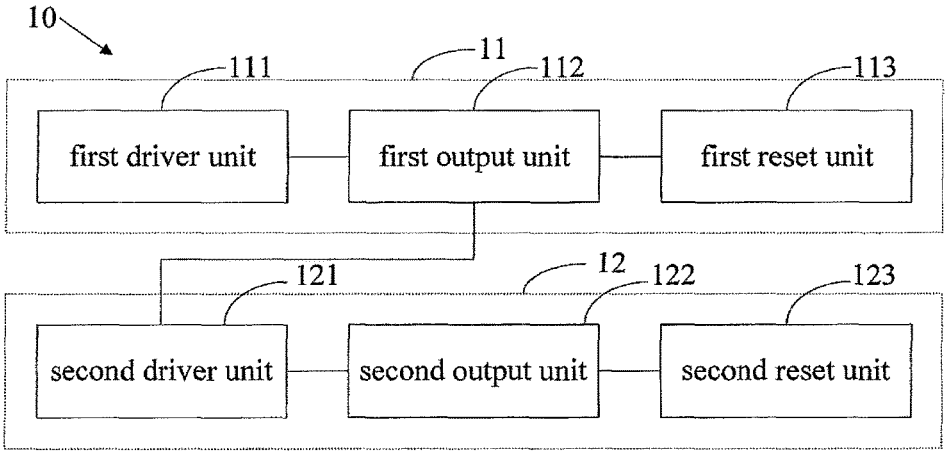
FIG. 1 is a structural diagram of a preferred embodiment of a GOA circuit of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto.

In the drawings, the same reference symbol represents the same or similar components.

FIG. 1 is a structural diagram of a preferred embodiment of a gate driver on array (GOA) circuit of the present invention. The GOA circuit of this preferred embodiment is used for driving scan lines of a corresponding liquid crystal display panel. The GOA circuit 10 comprises a first driver module 11 for driving an odd-numbered row of pixel units and a second driver module 12 for driving an even-numbered row of pixel units.

The first driver module 11 comprises a first driver unit 111, a first output unit 112, and a first reset unit 113. The second driver module 12 comprises a second driver unit 121, a second output unit 122, and a second reset unit 123.

The first driver unit 111 is used for receiving a previous stage cascade signal, and generating a cascade drive signal and a reset signal according to the cascade signal. The first output unit 112 is used for transmitting the cascade drive signal and a clock signal in a first state passing through a clock inverter, and generating a present stage scan drive signal and a present stage cascade signal. The first reset unit 113 is used for cancelling the present stage scan drive signal according to the reset signal.

The second driver unit 121 is used for receiving the previous stage cascade signal, and generating the cascade drive signal and the reset signal according to the cascade signal. The second output unit 122 is used for transmitting the cascade drive signal and a clock signal in a second state passing through a transmission gate, and generating the present stage scan drive signal and the present stage cascade signal. The second reset unit 123 is used for cancelling the present stage scan drive signal according to the reset signal.

An electric potential of the clock signal in the first state is opposite to an electric potential of the clock signal in the second state.

Figure 2:
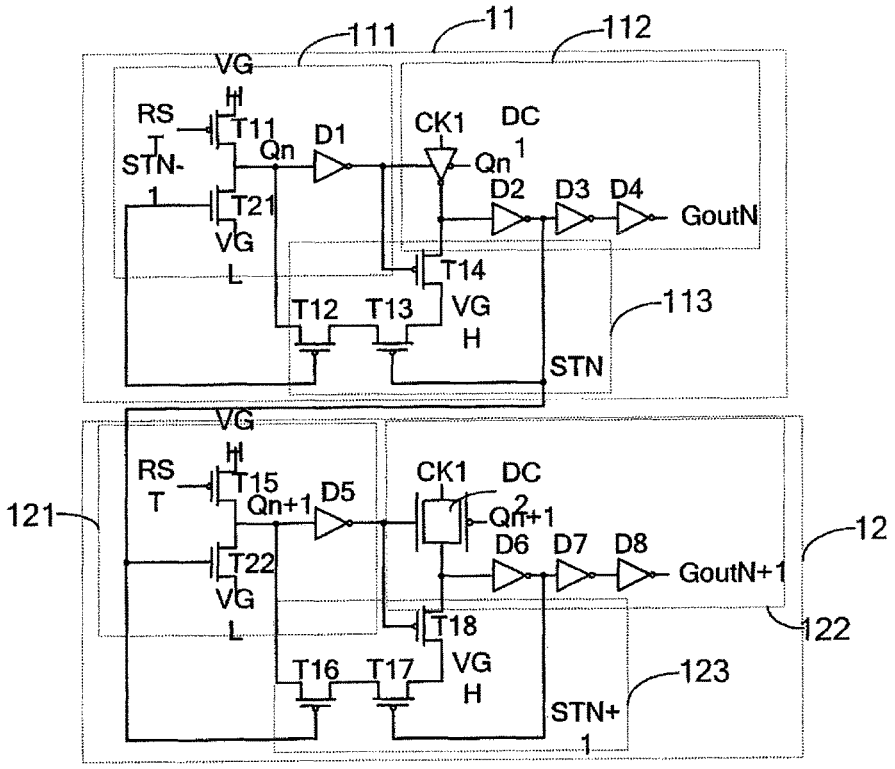
FIG. 2 is a specific circuit diagram of a first driver module and a second driver module of a preferred embodiment of a GOA circuit of the present invention.

FIG. 2 is a specific circuit diagram of a first driver module and a second driver module of a preferred embodiment of a GOA circuit of the present invention. The first driver unit 111 of the first driver module 11 comprises a first PMOS transistor T11, a first NMOS transistor T21, and a first inverting amplifier D1.

A control terminal of the first PMOS transistor T11 is connected with a reset signal source. An input terminal of the first PMOS transistor T11 is connected with a high voltage signal source VGH. An output terminal of the first PMOS transistor T11 is connected with an input terminal of the first inverting amplifier D1 and an output terminal of the first NMOS transistor T21, respectively. The previous stage cascade signal STN−1 is inputted into a control terminal of the first NMOS transistor T21. An input terminal of the first NMOS transistor T21 is connected with a low voltage signal source VGL.

The first output unit 112 comprises a clock inverter DC1, a second inverting amplifier D2, a third inverting amplifier D3, and a fourth inverting amplifier D4.

A control terminal of the clock inverter DC1 is connected with an output terminal of the first driver unit 111. The clock signal in the first state is inputted into an input terminal of the clock inverter DC1. An output terminal of the clock inverter DC1 is connected with an input terminal of the second inverting amplifier D2. An output terminal of the second inverting amplifier D2 is connected with an input terminal of the third inverting amplifier D3. An output terminal of the third inverting amplifier D3 is connected with an input terminal of the fourth inverting amplifier D4. The present stage scan drive signal GoutN is outputted by an output terminal of the fourth inverting amplifier D4. The present stage cascade signal STN is outputted by the output terminal of the second inverting amplifier D2.

The first reset unit 113 comprises a second PMOS transistor T12, a third PMOS transistor T13, and a fourth PMOS transistor T14.

An output terminal of the second PMOS transistor T12 is connected with the output terminal of the first PMOS transistor T11. The previous stage cascade signal STN−1 is inputted into a control terminal of the second PMOS transistor T12. An input terminal of the second PMOS transistor T12 is connected with an output terminal of the third PMOS transistor T13. The present stage cascade signal STN is inputted into a control terminal of the third PMOS transistor T13. An input terminal of the third PMOS transistor T13 is connected with the high voltage signal source VGH. An input terminal of the fourth PMOS transistor T14 is connected with the high voltage signal source VGH. An output terminal of the fourth PMOS transistor T14 is connected with the output terminal of the clock inverter DC1. A control terminal of the fourth PMOS transistor T14 is connected with an output terminal of the first inverting amplifier D1.

The second driver module 12 is a next stage drive circuit of the first driver module 11. That is, the present stage cascade signal STN of the first driver module 11 is the previous stage cascade signal STN of the second driver module 12.

The second driver unit 121 of the second driver module 12 comprises a fifth PMOS transistor T15, a second NMOS transistor T22, and a fifth inverting amplifier D5.

A control terminal of the fifth PMOS transistor T15 is connected with a reset signal source RST. An input terminal of the fifth PMOS transistor T15 is connected with a high voltage signal source VGH. An output terminal of the fifth PMOS transistor T15 is connected with an input terminal of the fifth inverting amplifier D5 and an output terminal of the second NMOS transistor T22, respectively. The previous stage cascade signal is inputted into a control terminal of the second NMOS transistor T22. An input terminal of the second NMOS transistor T22 is connected with the low voltage signal source VGL.

The second output unit 122 comprises a transmission gate DC2, a sixth inverting amplifier D6, a seventh inverting amplifier D7, and an eighth inverting amplifier D8.

A control terminal of the transmission gate DC2 is connected with an output terminal of the second driver unit 121. The clock signal in the first state is inputted into an input terminal of the transmission gate DC2. An output terminal of the transmission gate DC2 is connected with an input terminal of the sixth inverting amplifier D6. An output terminal of the sixth inverting amplifier D6 is connected with an input terminal of the seventh inverting amplifier D7. An output terminal of the seventh inverting amplifier D7 is connected with an input terminal of the eighth inverting amplifier D8. The present stage scan drive signal GoutN+1 is outputted by an output terminal of the eighth inverting amplifier D8. The present stage cascade signal STN+1 is outputted by the output terminal of the sixth inverting amplifier D6.

The second reset unit 123 comprises a sixth PMOS transistor T16, a seventh PMOS transistor T17, and an eighth PMOS transistor T18.

An output terminal of the sixth PMOS transistor T16 is connected with the output terminal of the fifth PMOS transistor T15. The previous stage cascade signal STN is inputted into a control terminal of the sixth PMOS transistor T16. An input terminal of the sixth PMOS transistor T16 is connected with an output terminal of the seventh PMOS transistor T17. The present stage cascade signal STN+1 is inputted into a control terminal of the seventh PMOS transistor T17. An input terminal of the seventh PMOS transistor T17 is connected with the high voltage signal source VGH. An input terminal of the eighth PMOS transistor T18 is connected with the high voltage signal source VGH. An output terminal of the eighth PMOS transistor T18 is connected with the output terminal of the transmission gate DC2. A control terminal of the eighth PMOS transistor T18 is connected with an output terminal of the fifth inverting amplifier D5.

Figure 3:
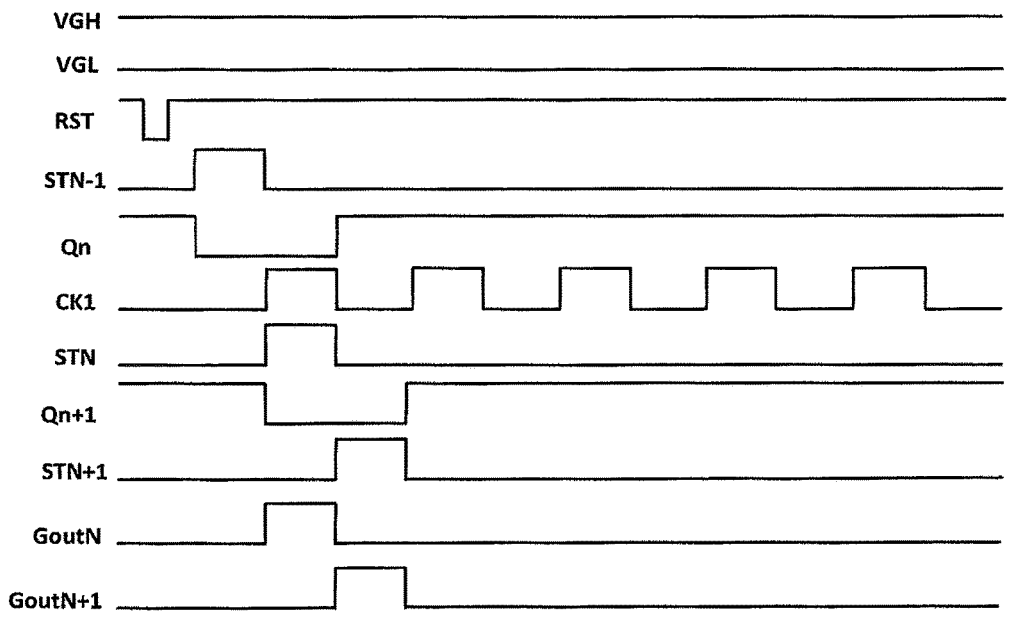
FIG. 3 is a sequence diagram for controlling signals of a preferred embodiment of a GOA circuit of the present invention.

FIG. 3 is a sequence diagram for controlling signals of a preferred embodiment of a GOA circuit of the present invention. If the STN−1 is at a high voltage and the RST is also at a high voltage, the first NMOS transistor T21 is turned on, and the first PMOS transistor T11 is turned off. The low voltage signal source VGL is transmitted to the first inverting amplifier D1 through the first PMOS transistor T11. The first inverting amplifier D1 outputs the amplified high voltage signal to the clock inverter DC1.

The clock inverter DC1 is under a control of the high voltage signal to process a reversal operation for the clock signal CK1 in the first state (a high voltage state), thereby outputting the low voltage signal to the second inverting amplifier D2. The second inverting amplifier D2 outputs the present stage cascade signal STN with the high voltage of the first driver module 11, The fourth inverting amplifier D4 outputs the present stage scan drive signal GoutN with the high voltage of the first driver module 11.

Then, the present stage cascade signal STN with the high voltage is transmitted to the second driver unit 121 of the second driver module 12. If the STN is at the high voltage and the RST is also at the high voltage, the second NMOS transistor T22 is turned on and the fifth PMOS transistor T15 is turned off. The low voltage signal source VGL is transmitted to the fifth inverting amplifier D5 through the first PMOS transistor T15. The fifth inverting amplifier D5 outputs the amplified high voltage signal to the transmission gate DC2.

The transmission gate DC2 is under a control of the high voltage signal to process a positive phase transmission operation for the clock signal CK1 in the second state (a low voltage state), thereby outputting the low voltage signal to the sixth inverting amplifier D6. The sixth inverting amplifier D6 outputs the present stage cascade signal STN+1 with the high voltage of the second driver module 12. The eighth inverting amplifier D8 outputs the present stage scan drive signal GoutN+1 with the high voltage of the second driver module 12.

The clock signal of the first driver module 11 is transferred to the second state. The clock inverter DC1 is under a control of the high voltage signal of the clock inverter DC1 to process a reversal operation for the clock signal CK1 in the second state (a low voltage state), thereby outputting the high voltage signal to the second inverting amplifier D2. The present stage cascade signal STN of the high voltage of the first driver module 11 is pulled up to the low voltage by the second inverting amplifier D2. The present stage scan drive signal GoutN of the high voltage of the first driver module 11 is also pulled down to the low voltage by the fourth inverting amplifier D4.

Since the present stage cascade signal STN of the first driver module 11 is at the low voltage and the previous stage cascade signal STN−1 of the first driver module 11 is also at the low voltage, the third PMOS transistor T13 and the second PMOS transistor T12 are turned on, and the first NMOS transistor T21 is turned off, thereby charging a Qn by the high voltage signal source VGH through the third PMOS transistor T13 and the second PMOS transistor T12, such that the Qn returns to the high voltage state. Also, the fifth PMOS transistor T15 is turned on. It ensures that the input terminal of the second inverting amplifier D2 is at the high voltage by passing the high voltage signal source VGH through the fifth PMOS transistor T15. Therefore, a produce process of the present stage scan drive signal GoutN of the first driver module 11 is accomplished.

Then, the clock signal of the second driver module 12 is transferred to the first state. The transmission gate DC2 is under a control of the high voltage signal to process a positive phase transmission operation for the clock signal CK1 in the first state (a high voltage state), thereby outputting the high voltage signal to the sixth inverting amplifier D6. The present stage cascade signal STN+1 of the high voltage of the second driver module 12 is pulled down to the low voltage by the sixth inverting amplifier D6. The present stage scan drive signal GoutN+1 of the high voltage of the second driver module is also polled down to the low voltage by the eighth inverting amplifier D8.

Since the present stage cascade signal STN+1 of the second driver module 12 is at the low voltage and the previous stage cascade signal STN of the second driver module 12 is also at the low voltage, the seventh PMOS transistor T17 and the sixth PMOS transistor T16 are turned on, and the second NMOS transistor T22 is turned off, thereby charging a Qn+1 by the high voltage signal source VGH through the seventh PMOS transistor T17 and the sixth PMOS transistor T16, such that the Qn+1 returns to the high voltage state. Also, the eighth PMOS transistor T18 is turned on. It ensures that the input terminal of the sixth inverting amplifier D6 is at the high voltage by passing the high voltage signal source VGH through the eighth PMOS transistor T18. Therefore, a produce process of the present stage scan drive signal GoutN+1 of the second driver module 12 is accomplished.

Figure 4:
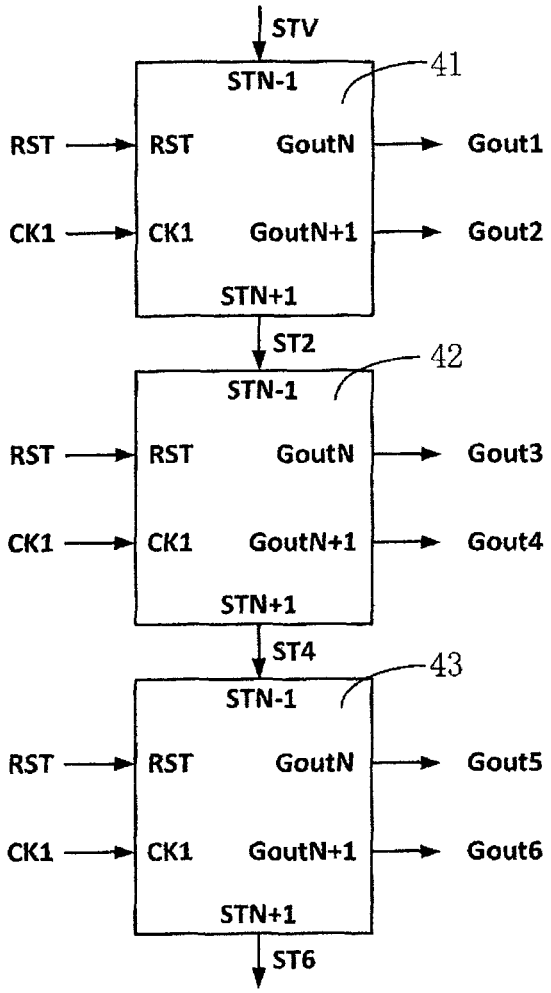
FIG. 4 is a specific circuit diagram of a plurality of first driver modules and a plurality of second driver modules of a preferred embodiment of a GOA circuit of the present invention.

FIG. 4 is a specific circuit diagram of a plurality of first driver modules and a plurality of second driver modules of a preferred embodiment of a GOA circuit of the present invention. In the GOA circuit, a driver unit is formed by a first driver module and a second driver module, such as a driver unit 41, a driver unit 42, and a driver unit 43 in FIG. 4. Input signals of the driver unit 41 include a reset signal RST, a clock signal CK1, and a cascade signal STV. The previous stage cascade signal STN−1 of the first driver module of the driver unit 41 is formed by the cascade signal STV. Output signals of the driver unit 41 include a scan drive signal Gout1 of the first driver module, a scan drive signal Gout2 of the second driver module, and a next stage cascade signal STN+1 (i.e., a cascade signal ST2) generated by the second driver module.

Input signals of the driver unit 42 include a reset signal RST, a clock signal CK1, and a cascade signal ST2. The previous stage cascade signal STN−1 of the first driver module of the driver unit 42 is formed by the cascade signal ST2. Output signals of the driver unit 42 includes a scan drive signal Gout3 of the first driver module, a scan drive signal Gout4 of the second driver module, and a next stage cascade signal STN+1 (i.e., a cascade signal ST4) generated by the second driver module.

Input signals of the driver unit 43 include a reset signal RST, a clock signal CK1, and a cascade signal ST4. The previous stage cascade signal STN−1 of the first driver module of the driver unit 43 is formed by the cascade signal ST4. Output signals of the driver unit 43 include a scan drive signal Gout5 of the first driver module, a scan drive signal Gout6 of the second driver module, a next stage cascade signal STN+1 (i.e., a cascade signal ST6) generated by the second driver module.

Accordingly, a cascade drive process of the plurality of driver units is accomplished.

The present invention also provides a liquid crystal display panel. The liquid crystal display panel comprises data lines, scan lines, pixel units defined by the data lines and the scan lines, and a corresponding GOA circuit.

The GOA circuit comprises a first driver module for driving an odd-numbered row of pixel units and a second driver module for driving an even-numbered row of pixel units.

The first driver module comprises a first driver unit, a first output unit, and a first reset unit. The second driver module comprises a second driver unit, a second output unit, and a second reset unit.

The first driver unit is used for receiving a cascade signal of a previous stage and generating a cascade drive signal and a reset signal according to the cascade signal. The first output unit is used for transmitting the cascade drive signal and a clock signal in a first state passing through a clock inverter, and generating a scan drive signal of a present stage and a cascade signal of the present stage. The first reset unit is used for cancelling the scan drive signal of the present stage according to the reset signal.

The second driver unit is used for receiving the cascade signal of the previous stage, and generating the cascade drive signal and the reset signal according to the cascade signal. The second output unit is used for transmitting the cascade drive signal and a clock signal in a second state passing through a transmission gate, and generating the scan drive signal of the present stage and the cascade signal of the present stage. The second reset unit is used for cancelling the scan drive signal of the present stage according to the reset signal.

An electric potential of the clock signal in the first state is opposite to an electric potential of the clock signal in the second state.

A specific working principle of the liquid crystal display panel of the present invention is the same or similar to the preferred embodiment of the above GOA circuit. Refer to a corresponding description of the preferred embodiment of the above GOA circuit for more detail.

In the GOA circuit and the liquid crystal display panel of the present invention, by applying a common clock signal to the first driver module and the second driver module, an occupancy space of the GOA circuit is thus decreased, and it is easy to design the liquid crystal display panel with a narrow frame. The technical problem caused by the existing GOA circuit in the liquid crystal display panel occupies a large space, so it disadvantageous to design the liquid crystal display panel with a narrow frame is solved.

The above descriptions are merely preferable embodiments of the present invention, and are not intended to limit the scope of the present invention. Any modification or replacement made by those skilled in the art without departing from the spirit and principle of the present invention should fall within the protection scope of the present invention. Therefore, the protection scope of the present invention is subject to the appended claims.

What is claimed is:

1. A gate driver on array (GOA) circuit, comprising: a first driver module for driving an odd-numbered row of pixel units and a second driver module for driving an even-numbered row of pixel units; wherein the first driver module comprises: a first driver unit receiving a previous stage cascade signal and generating a cascade drive signal and a reset signal according to the cascade signal; a first output unit transmitting the cascade drive signal and a clock signal in a first state passing through a clock inverter, and generating a present stage scan drive signal and a present stage cascade signal; and a first reset unit cancelling the present stage scan drive signal according to the reset signal; the second driver module comprises: a second driver unit receiving the previous stage cascade signal, and generating the cascade drive signal and the reset signal according to the cascade signal; a second output unit transmitting the cascade drive signal and a clock signal in a second state passing through a transmission gate, and generating the present stage scan drive signal and the present stage cascade signal; and a second reset unit cancelling the present stage scan drive signal according to the reset signal; wherein an electric potential of the clock signal in the first state is opposite to an electric potential of the clock signal in the second state, wherein the first driver unit comprises a first PMOS transistor, a first NMOS transistor, and a first inverting amplifier; a control terminal of the first PMOS transistor is connected with a reset signal source, an input terminal of the first PMOS transistor is connected with a high voltage signal source, an output terminal of the first PMOS transistor is connected with an input terminal of the first inverting amplifier and an output terminal of the first NMOS transistor, respectively; the previous stage cascade signal is inputted into a control terminal of the first NMOS transistor, and an input terminal of the first NMOS transistor is connected with a low voltage signal source, wherein the first output unit comprises the clock inverter, a second inverting amplifier, a third inverting amplifier, and a fourth inverting amplifier; a control terminal of the clock inverter is connected with an output terminal of the first driver unit, the clock signal in the first state is inputted into an input terminal of the clock inverter, an output terminal of the clock inverter is connected with an input terminal of the second inverting amplifier; an output terminal of the second inverting amplifier is connected with an input terminal of the third inverting amplifier, an output terminal of the third inverting amplifier is connected with an input terminal of the fourth inverting amplifier, the present stage scan drive signal is outputted by an output terminal of the fourth inverting amplifier, and the present stage cascade signal is outputted by the output terminal of the second inverting amplifier, wherein the first reset unit comprises a second PMOS transistor, a third PMOS transistor, and a fourth PMOS transistor; an output terminal of the second PMOS transistor is connected with the output terminal of the first PMOS transistor, the previous stage cascade signal is inputted into a control terminal of the second PMOS transistor, an input terminal of the second PMOS transistor is connected with an output terminal of the third PMOS transistor; the present stage cascade signal is inputted into a control terminal of the third PMOS transistor, and an input terminal of the third PMOS transistor is connected with the high voltage signal source; an input terminal of the fourth PMOS transistor is connected with the high voltage signal source, an output terminal of the fourth PMOS transistor is connected with the output terminal of the clock inverter, and a control terminal of the fourth PMOS transistor is connected with an output terminal of the first inverting amplifier, and wherein the second driver unit comprises a fifth PMOS transistor, a second NMOS transistor, and a fifth inverting amplifier; a control terminal of the fifth PMOS transistor is connected with a reset signal source, an input terminal of the fifth PMOS transistor is connected with a high voltage signal source, an output terminal of the fifth PMOS transistor is connected with an input terminal of the fifth inverting amplifier and an output terminal of the second NMOS transistor, respectively; the previous stage cascade signal is inputted into a control terminal of the second NMOS transistor, and an input terminal of the second NMOS transistor is connected with the low voltage signal source.

2. The GOA circuit as claimed in claim 1, wherein the second output unit comprises the transmission gate, a sixth inverting amplifier, a seventh inverting amplifier, and an eighth inverting amplifier; a control terminal of the transmission gate is connected with an output terminal of the second driver unit, the clock signal in the first state is inputted into an input terminal of the transmission gate, an output terminal of the transmission gate is connected with an input terminal of the sixth inverting amplifier; an output terminal of the sixth inverting amplifier is connected with an input terminal of the seventh inverting amplifier, an output terminal of the seventh inverting amplifier is connected with an input terminal of the eighth inverting amplifier, the present stage scan drive signal is outputted by an output terminal of the eighth inverting amplifier, and the present stage cascade signal is outputted by the output terminal of the sixth inverting amplifier.

3. The GOA circuit as claimed in claim 1, wherein the second reset unit comprises a sixth PMOS transistor, a seventh PMOS transistor, and an eighth PMOS transistor; an output terminal of the sixth PMOS transistor is connected with the output terminal of the fifth PMOS transistor, the previous stage cascade signal is inputted into a control terminal of the sixth PMOS transistor, an input terminal of the sixth PMOS transistor is connected with an output terminal of the seventh PMOS transistor; the present stage cascade signal is inputted into a control terminal of the seventh PMOS transistor, an input terminal of the seventh PMOS transistor is connected with the high voltage signal source; an input terminal of the eighth PMOS transistor is connected with the high voltage signal source, an output terminal of the eighth PMOS transistor is connected with the output terminal of the transmission gate, and a control terminal of the eighth PMOS transistor is connected with an output terminal of the fifth inverting amplifier.

4. The GOA circuit as claimed in claim 1, wherein a state of the clock signal is changed according to a transmission cycle of the cascade signal.

5. The GOA circuit as claimed in claim 1, wherein if the reset signal is at a low voltage, the corresponding first driver module or the corresponding second driver module is reset.

6. A liquid crystal display panel, comprising a gate driver on array (GOA) circuit, wherein the GOA circuit comprises a first driver module for driving an odd-numbered row of pixel units and a second driver module for driving an even-numbered row of pixel units; wherein the first driver module comprises: a first driver unit receiving a previous stage cascade signal and generating a cascade drive signal and a reset signal according to the cascade signal; a first output unit transmitting the cascade drive signal and a clock signal in a first state passing through a clock inverter, and generating a present stage scan drive signal and a present stage cascade signal; and a first reset unit cancelling the present stage scan drive signal according to the reset signal; the second driver module comprises: a second driver unit receiving the previous stage cascade signal, and generating the cascade drive signal and the reset signal according to the cascade signal; a second output unit transmitting the cascade drive signal and a clock signal in a second state passing through a transmission gate, and generating the present stage scan drive signal and the present stage cascade signal; and a second reset unit cancelling the present stage scan drive signal according to the reset signal; wherein an electric potential of the clock signal in the first state is opposite to an electric potential of the clock signal in the second state, wherein the first driver unit comprises a first PMOS transistor, a first NMOS transistor, and a first inverting amplifier; a control terminal of the first PMOS transistor is connected with a reset signal source, an input terminal of the first PMOS transistor is connected with a high voltage signal source, an output terminal of the first PMOS transistor is connected with an input terminal of the first inverting amplifier and an output terminal of the first NMOS transistor, respectively; the previous stage cascade signal is inputted into a control terminal of the first NMOS transistor, and an input terminal of the first NMOS transistor is connected with a low voltage signal source, wherein the first output unit comprises the clock inverter, a second inverting amplifier, a third inverting amplifier, and a fourth inverting amplifier; a control terminal of the clock inverter is connected with an output terminal of the first driver unit, the clock signal in the first state is inputted into an input terminal of the clock inverter, an output terminal of the clock inverter is connected with an input terminal of the second inverting amplifier; an output terminal of the second inverting amplifier is connected with an input terminal of the third inverting amplifier, an output terminal of the third inverting amplifier is connected with an input terminal of the fourth inverting amplifier, the present stage scan drive signal is outputted by an output terminal of the fourth inverting amplifier, and the present stage cascade signal is outputted by the output terminal of the second inverting amplifier, wherein the first reset unit comprises a second PMOS transistor, a third PMOS transistor, and a fourth PMOS transistor; an output terminal of the second PMOS transistor is connected with the output terminal of the first PMOS transistor, the previous stage cascade signal is inputted into a control terminal of the second PMOS transistor, an input terminal of the second PMOS transistor is connected with an output terminal of the third PMOS transistor; the present stage cascade signal is inputted into a control terminal of the third PMOS transistor, and an input terminal of the third PMOS transistor is connected with the high voltage signal source; an input terminal of the fourth PMOS transistor is connected with the high voltage signal source, an output terminal of the fourth PMOS transistor is connected with the output terminal of the clock inverter, and a control terminal of the fourth PMOS transistor is connected with an output terminal of the first inverting amplifier, and wherein the second driver unit comprises a fifth PMOS transistor, a second NMOS transistor, and a fifth inverting amplifier; a control terminal of the fifth PMOS transistor is connected with a reset signal source, an input terminal of the fifth PMOS transistor is connected with a high voltage signal source, an output terminal of the fifth PMOS transistor is connected with an input terminal of the fifth inverting amplifier and an output terminal of the second NMOS transistor, respectively; the previous stage cascade signal is inputted into a control terminal of the second NMOS transistor, and an input terminal of the second NMOS transistor is connected with the low voltage signal source.

7. The liquid crystal display panel as claimed in claim 6, wherein the second output unit comprises the transmission gate, a sixth inverting amplifier, a seventh inverting amplifier, and an eighth inverting amplifier; a control terminal of the transmission gate is connected with an output terminal of the second driver unit, the clock signal in the first state is inputted into an input terminal of the transmission gate, an output terminal of the transmission gate is connected with an input terminal of the sixth inverting amplifier; an output terminal of the sixth inverting amplifier is connected with an input terminal of the seventh inverting amplifier, an output terminal of the seventh inverting amplifier is connected with an input terminal of the eighth inverting amplifier, the present stage scan drive signal is outputted by an output terminal of the eighth inverting amplifier, and the present stage cascade signal is outputted by the output terminal of the sixth inverting amplifier.

8. The liquid crystal display panel as claimed in claim 6, wherein the second reset unit comprises a sixth PMOS transistor, a seventh PMOS transistor, and an eighth PMOS transistor; an output terminal of the sixth PMOS transistor is connected with the output terminal of the fifth PMOS transistor, the previous stage cascade signal is inputted into a control terminal of the sixth PMOS transistor, an input terminal of the sixth PMOS transistor is connected with an output terminal of the seventh PMOS transistor; the present stage cascade signal is inputted into a control terminal of the seventh PMOS transistor, an input terminal of the seventh PMOS transistor is connected with the high voltage signal source; an input terminal of the eighth PMOS transistor is connected with the high voltage signal source, an output terminal of the eighth PMOS transistor is connected with the output terminal of the transmission gate, and a control terminal of the eighth PMOS transistor is connected with an output terminal of the fifth inverting amplifier.

9. The liquid crystal display panel as claimed in claim 6, wherein a state of the clock signal is changed according to a transmission cycle of the cascade signal.

10. The liquid crystal display panel as claimed in claim 6, wherein if the reset signal is at a low voltage, the corresponding first driver module or the corresponding second driver module is reset.

* * * * *